US011375858B1

(12) United States Patent
Stander

(10) Patent No.: US 11,375,858 B1
(45) Date of Patent: Jul. 5, 2022

(54) SPLASHGUARD

(71) Applicant: Jordan D. Stander, Foristell, MO (US)

(72) Inventor: Jordan D. Stander, Foristell, MO (US)

( * ) Notice: Subject to any disclaimer, the term of this patent is extended or adjusted under 35 U.S.C. 154(b) by 0 days.

(21) Appl. No.: 17/067,951

(22) Filed: Oct. 12, 2020

Related U.S. Application Data

(60) Provisional application No. 62/915,722, filed on Oct. 16, 2019.

(51) Int. Cl.
*A47K 3/00* (2006.01)
*A47K 3/30* (2006.01)

(52) U.S. Cl.
CPC ..... *A47K 3/302* (2013.01); *A47K 2003/307* (2013.01)

(58) Field of Classification Search
CPC .. A47K 3/302; A47K 2003/307; A47K 3/001; A47K 3/004; A47K 3/30
USPC ..... 4/559, 609
See application file for complete search history.

(56) References Cited

U.S. PATENT DOCUMENTS

| | | | | |
|---|---|---|---|---|
| 1,791,696 | A | 2/1931 | Alexander | |
| 3,213,565 | A | 10/1965 | Grosz | |
| 3,444,564 | A * | 5/1969 | Lavacchia | A47K 3/004 4/559 |
| D222,590 | S | 11/1971 | Chase | |
| 3,984,880 | A | 10/1976 | Schrameyer | |
| 4,888,835 | A | 12/1989 | Baumann | |
| 5,381,564 | A | 1/1995 | Carroll | |
| 5,621,928 | A * | 4/1997 | Willhight | A47K 3/001 4/559 |
| 5,701,615 | A * | 12/1997 | Baker | A47K 3/001 4/559 |
| 6,035,461 | A | 3/2000 | Nguyen | |
| 6,212,705 | B1 | 4/2001 | Kramer | |
| 6,341,388 | B1 | 1/2002 | Roberts | |
| 6,745,415 | B1 | 6/2004 | Brettell | |
| D734,839 | S | 7/2015 | Jones | |
| 9,238,907 | B2 * | 1/2016 | Murray | E03C 1/181 |
| 2004/0231045 | A1 | 11/2004 | Carter | |
| 2011/0258768 | A1 | 10/2011 | Spingola et al. | |

* cited by examiner

*Primary Examiner* — J C Jacyna
(74) *Attorney, Agent, or Firm* — Creativenture Law, LLC; Dennis J M Donahue, III; Kevin Staed

(57) ABSTRACT

The invention is a splashguard for placement on and over a bathtub rim which can hold items or providing a play-area for children while preventing water from splashing out of the bathtub. The splashguard includes a planar shelf that connects to the bathtub's rim with one set of releasable and reusable fasteners and a flap that extends downward along the bathtub's inner sidewall from the forward edge of the shelf and further secures the splashguard to the inner sidewall with another set of releasable and reusable fasteners. To prevent water from spilling over the cantilevered rearmost edge of the planar shelf, a wall is provided around the back and sides of the shelf. The splashguard allows for a space between the ends of the splashguard and at least one of the walls at an end of the bathtub, allowing uninterrupted accessibility to the bathtub.

20 Claims, 4 Drawing Sheets

SPLASHGUARD

CROSS-REFERENCE TO RELATED APPLICATIONS

This application claims priority from U.S. Provisional Patent Application No. 62/915,722 filed Oct. 16, 2020, which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to a splashguard for a bathtub, and more particularly to a splashguard for a bathtub that does not interfere with entry and exit from a bathtub.

Related Art

Splashguards have long been used for preventing water from spilling out of bathtubs while simultaneously providing additional play area for children and increased storage surface area for an adult when taking a bath. During bath time children routinely play on the top edge of the bathtub. This causes water to pour over the side of the bathtub, making a wet slippery floor that can be dangerous to children when they get out, and the person giving them the bath. It can also lead to water damage in the bathroom, or other parts of the house depending on where the bathroom is located. There is also the headache of constantly cleaning up the water, as well as trying to train children to not play on the edge of the bathtub. Similarly, adults often take baths for cleaning and relaxation and while doing so may light candles around the bathtub, read a book, or would prefer to have a surface close by for holding items that they do not want to get wet. Accordingly, there is a desire to those in the art to provide a play or storage area that also doubles as splashguard to prevent water from spilling out of the tub.

Most prior art devices teach or suggest a splashguard that extends between the sidewalls of the shower stall in which the bathtub sits. Although effective at preventing water from spilling from the bathtub and providing an increased surface area for play or storage, these devices interfere with entry and exit from bathtubs wherein a person must step over the splashguard or the splashguard must be removed when entering and existing. Accordingly, there remains a desire to those having an ordinary skill in the art to provide an improved splashguard that effectively expands the surface area of the edge of the bathtub and prevents spilling while simultaneously allowing uninterrupted entry and egress from the bathtub while the splashguard is attached thereto.

An example of a splashguard which extends the entire length of the bathtub is described in US Pat. Pub. No. 2011/0258768. As noted in the '768 publication, there is a particular desire for splashguards that can be used with children who play during bathing. Often children are excited by what they see as an opportunity to play in the bathtub and use the time to splash around in the water or to play with toys. This frolicking can lead to large volumes of water being thrown onto a supervising caregiver or onto the floor. Excess water on a bathroom floor can result in hazardously slick conditions for children and caregivers alike. Further still, bathtubs are not inherently designed to provide play surfaces for children or for increased storage surfaces for adults who may also benefit from an expanded bathtub edge as explained below. Accordingly, there is a desire to provide such expanded surfaces while simultaneously preventing water from spilling out of the bathtub.

To combat spilling, the '768 publication describes a splashguard that is placed along the edge of a bathtub allowing the supervisor to remain in clear sight of a bathing child, while providing an extended deflecting surface for keeping water in a bathtub. Although effective at preventing splashing onto the floor, the splashguards described by the '768 publication have several drawbacks. One drawback of the '768 publication's splashguards is the lack of any space between at least one end of the splashguards and the walls at either end of the tub. The space is important to allow uninterrupted entry and egress from the bathtub. Rather than providing for any such space, the '768 publication teaches that the splashguards should include wall members that extend the length of the bathtub all the way to the walls. Even when the splashguard's wall terminates in an L-shaped enclosure when viewed from above, the '768 publication teaches that the sides are flushly mounted against the shower walls to prevent water from getting out of either side of the splashguard. Although the lack of any space between the sides of the splashguards and the shower walls at the ends of the tub would prevent water from splashing around the splashguards' sides, it makes accessibility to the tub much more difficult, such as for entry and egress, and it makes it impossible for an adult to sit on the side of the tub and help wash a child's hair, thereby increasing the inconvenience of splashguards that are based on the teaching of the '768 publication (i.e., "'768-type splashguard"). Therefore, the '768-type splashguard interferes with entering and exiting the tub and renders the side of the tub inaccessible for a parent to use when helping to wash a child. Accordingly, there remains a need for a splashguard that allows for freely entering and exiting the tub without having to climb over the splashguard and that allows a person to sit on the side of tub proximate to at least one of the walls at the end of the tub.

It will be recognized that although the '768 publication states that the splashguard can prevent water from getting around either side of the wall when the L-shaped enclosure is flushly mounted against the shower walls, there would be nothing from preventing water from getting underneath the enclosure's sides because the lip terminates where the inner wall of the tub curves at the ends of the tub which is necessarily before the end of the enclosure due to the thickness of the tub's rim. There is nothing in the '768 publication that suggests how the lip might be modified to seal between the shelf and the top of the rim at the ends of the enclosure. Therefore, although the '768 publication suggests that it provides a complete seal over the entire length of the bathtub's rim between both ends of a tub and the shower wall at the ends, the '768-type splashguard cannot provide a complete seal according to the teaching of the '768 publication. Accordingly, for those splashguards that have a wall extending the entire length of a tub and forming an enclosure over the bathtub's rim, there remains a need for a modified lip or other seal for the enclosure's ends between the shelf and the rim.

The '768 publication also explains that the splashguard should have a lip that extends downward from the shelf and overhangs the bathtub's inner wall so that when water splashes up against the wall and onto the shelf, the lip directs the water back into the tub. However, although the lip may be in contact with the inner wall, it is not in any way fastened to the inner wall of the tub. According to the teaching of the '768 publication, the only fastening means between the splashguard and the tub is on the underside of the shelf, such as with a series of suction cups. The lack of any fasteners between the lip and the bathtub's inner wall also limits the use of '768-type splashguard to only those tubs that have a rim that is flat enough and wide enough for the suction cups to be secured to the surface. Therefore, the lack of fasteners between the lip and the bathtub's inner wall prevents '768-type splashguard from being used with many freestanding bathtubs that have relatively narrow rims and which may be rounded rather than flat, such as the style of many clawfoot bathtubs. Accordingly, there remains a need for a splashguard that is not limited in its use with particular bathtub shapes and is better suited to be removably fastened to bathtubs with rims that are not as wide as the shelves of the splashguards.

The '768 publication particularly teaches that the horizontal supporting shelf member extending from the wall is approximately the width of a bathtub rim which means that the wall does not extend much past the bathtub's outer wall. Since there is no fastener or other attachment between the lip and the bathtub's inner wall, the '768-type splashguard's wall cannot extend much past the outer wall without risking the splashguard tipping over the bathtub's outer wall. The lack of any attachment between the lip and the bathtub's inner wall for the '768-type splashguard allows the shelf to rock on the rim of the sidewall to which it is fastened so that the splashguard's wall rotates outward over the bathtub's outer wall and the lip rotates upward from the bathtub's inner wall. Since the '768-type splashguard can rock around the longitudinal axis of the shelf, the back wall cannot be cantilevered any significant distance beyond the tub's outer wall or it will create a moment arm that causes the wall to tip outward over the outer wall and splashed water will either leak between the sides of the shelf and the tub's walls or will collect between the angled back shelf and the surrounding wall, thereby adding more weight into the cantilevered section causing it to tip further back and ultimately tipping off the rim. Accordingly, the width of the shelf being limited to the width of the bathtub rim according to the teaching of the '768 publication is an important feature of the invention that cannot be modified without changing the principle of operation of the 768-type splashguard. Therefore, there remains a need for an improved splashguard that prevents rocking on bathtub rims to avoid leaks and/or failure of the connection to the bathtub rim, especially when splashguards are desired with shelves that are wider than the bathtub rims.

The splashguard lip disclosed by the '768 publication is so narrow that it does not provide sufficient surface area between the underside of the shelf and the end of the lip to accommodate suction cups like the ones used on the underside of the shelf nor does it provide significant counterbalance to a shelf that is cantilevered on the bathtub's rim past the outer wall. Accordingly, a different structure than the narrow lip would be necessary to attach suction cups sufficiently distanced from the underside of the shelf that they can be secured to the inner wall, and more mass from the structure would also help to counterbalance a cantilevered shelf. Therefore, there also remains a need for an improved splashguard that has a structure that can be releasably attached to the bathtub's inner wall as well having fasteners on the underside of the shelf that can be releasably attached to the bathtub's rim.

Other splashguards are permanently mounted to the edge of a bathtub which is inconvenient for adults getting in and out of the shower who must step over the barrier. Further, other removable splashguards are made from shields that connect to the edge of the bathtub, such as shown and described in U.S. Pat. Nos. 1,791,696 and 5,365,619. In these embodiments the shields prevent water from splashing out of the bathtub but are limited to a vertical splashguard and therefore do not provide any additional surface area for playing or storage. Further, as with the '768 publication, these splashguards extend the length of the bathtub and similarly do not provide an easy means of entry and exit when the guard is attached.

Another problem with known splashguards which extend between the sidewalls of the shower stall is that they are not easily used with bathtubs that are not situated within a shower stall. For example, the ends of the splashguard described in the '768 publication are flush to the walls of the shower stall to assure that water does not spill from the bathtub between the ends of the guard and the walls of the shower. Accordingly, this splashguard is not intended to function with freestanding bathtubs and is also particularly sized for specific bathtubs. Considering this limitation, there remains a desire to those in the art to provide a splashguard that can be used with multiple bathtub sizes in addition to bathtubs that are not situated within a shower stall.

Another type of bathtub tray and bracket assembly is disclosed in U.S. Pat. No. 3,444,564 (i.e., "'564-type splashguard"). As with the '768-type splashguard, the '564-type splashguard does not have any lip, flange, or other wall that extends downward from the ends of the shelf to the bathtub's rim which would prevent water splashed underneath the shelf from collecting on the rim and spilling over onto the floor adjacent to the bathtub. This problem in the '564-type splashguard is exacerbated because, unlike the '768-type splashguard which has a lip that extends downward from the front of the shelf to the bathtub's rim, there is no such lip, flange, or other wall, in on the front section of the '564-type splashguard that extends over and is spaced from the bathtub's inner sidewall so there is no structure that could prevent splashes underneath this front section. Accordingly, there is a need for some structure between the front section of a splashguard and the bathtub's inner sidewall as well as the sides of the splashguard and the bathtub's rim.

The '564-type splashguard has a number of advantages over the '768-type splashguard, including its improved accessibility for the bathtub at either side of the assembly, its use of suction cups to hold the brackets to the bathtub's inner sidewall as well as suction cups to hold the brackets to the bathtub's rim which reduces the rocking and provides for a more secure connection to the bathtub (at least for the bracket portion of the assembly), and its lip that is wider than the height of the back wall provides a counterbalance to the shelf when it is a cantilevered on the bathtub's rim and extends beyond the outer sidewall. The '564 Patent particularly teaches that its bracket is separate from the splashguard tray which allows for changes in the orientation of the bracket and the tray with respect to the bathtub. The '564 Patent also teaches that the bracket has multiple threaded openings that are spaced along the length of the bracket which allow the mounting location of the suction cups to be varied along the length of the bracket depending on the particular orientation of the assembly and the space available for the assembly on different sides of the bathtub.

Although the '564-type splashguard has some advantages over the '768-type splashguard, it's use of a bracket that is separate from the splashguard tray is detrimental because it adds complexity to the assembly and can result in an unintentional premature separation of the tray from bracket when a child is using it while bathing. The separate bracket and tray assembly is an important feature of the '564 Patent's invention which is necessary for its proper operation; therefore, the separate bracket and tray assembly cannot be modified without changing the principle of operation of the '564 Patent. One of the orientations taught by the '564 Patent is a reversed position in which the wall around the shelf is rotated so that it is positioned within the tub, and the back wall is horizontal so it serves as a shelf within the bathtub. Since the back wall extends into the bathtub space from the inner sidewall, the height of the back wall is kept rather low as compared to other splashguards. The back wall height is less than one-half the width of the shelf. Accordingly, there remains a need for a splashguard with a more simplistic structural assembly in which the tray will not become unintentionally separated from the mounts that hold the splashguard in place on the bathtub. Additionally, it would also be preferably for an improved splashguard to have a back wall height that is larger than what is taught by the '564 Patent when evaluated relative to width of the shelf.

Another problem with the '768-type splashguard and the '564-type splashguard is their lack of any reinforcement on the bottom of the shelf between the suction cups. As evident from both of these references, the bottom side of the shelf is spaced away from the bathtub's rim with no structural support between the shelf and the rim. Therefore, not only is there no barrier to water spilling over the rim from water that may splash between the bottom of the shelf and the rim, there is nothing to prevent the shelf from bending or bowing when pressure is applied to it, such as when a child may be playing with a toy on the surface. Such bowing and bending could result in pooling of water and could result in the growth of mold and mildew and may also result in one side of the suction cups being deflected away from the rim, thereby losing the suction and any holding power and causing the splashguard to topple off of the rim. Similarly, in the '564-type splashguard which has suction cups and a space between the front surface and the bathtub's inner sidewall without any support structure therebetween, a similar bending and bowing could cause these suction cups to lose their holding power. Accordingly, there remains the need for a more sturdy shelf structure and front section that will help prevent bending and bowing of the shelf and front section and help maintain suction between the suction cups and the rim and the sidewall, respectively.

SUMMARY OF THE INVENTION

The splashguard described herein relates to bathtub utility device and more particularly to a water splashguard mountable on a bathtub's rim for the purpose of expanding the surface area of a portion of the rim for storage or playing while also preventing water from spilling out of the bathtub onto the floor. Further, it is an aspect of the splashguard described herein to effectively expanded the surface of the bathtub's rim and prevent spilling while also allowing uninterrupted entry and egress from the bathtub while the splashguard is connected thereto.

The splashguard according to the preferred embodiment includes a rectangular shelf surface with a back wall and a pair of sidewalls that keep water from spilling over the side edges and rearmost edge of the shelf and getting on the floor. A flap is connected to the shelf along the forward edge of the shelf, and the flap extends downward from the forward edge of the shelf into the bathtub, generally parallel to inner sidewall of the bathtub. Water on the surface of the planar shelf portion, which sits on the top rim of the bathtub, can therefore only run off the forward edge of the shelf and down the flap back into the bathtub.

To secure the splashguard to the bathtub, suction cups are provided on the underside of the shelf as well as on the backside of the flap that suction onto the rim of the bathtub and the inner sidewall in one easy step. Subsequently, the releasable connection provided by the suction cups allows the splashguard to be quickly removed and stored for later use.

In operation, the splashguard provides children an enlarged play area along the rim of the bathtub they can play with anything wet or dry, without spilling onto the bathroom floor. Alternatively, the splashguard can be used by adults who want to take a bath and have a large surface area for materials they do not want to get wet. For example, an adult may place a towel, candles books, drinks, food, electronic devices or similar items that they use in a bathtub on the surface of the splashguard and keep these items dry.

Regardless of whether a child or adult is using the splashguard, it is also an aspect of the invention to provide easy and uninterrupted entry and egress from the bathtub while the guard is attached. To provide such access to the bathtub, the guard is sized to be less than the length of the bathtub with spaces provided on each end of the splashguard between the sidewalls of the guard and the walls of the shower stall in which the bathtub is situated. Alternatively, the splashguard described herein can be used in free standing bathtubs that are not situated within a shower stall wherein a child or adult can easily enter or exit the bathtub on either end of the splashguard.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1A:
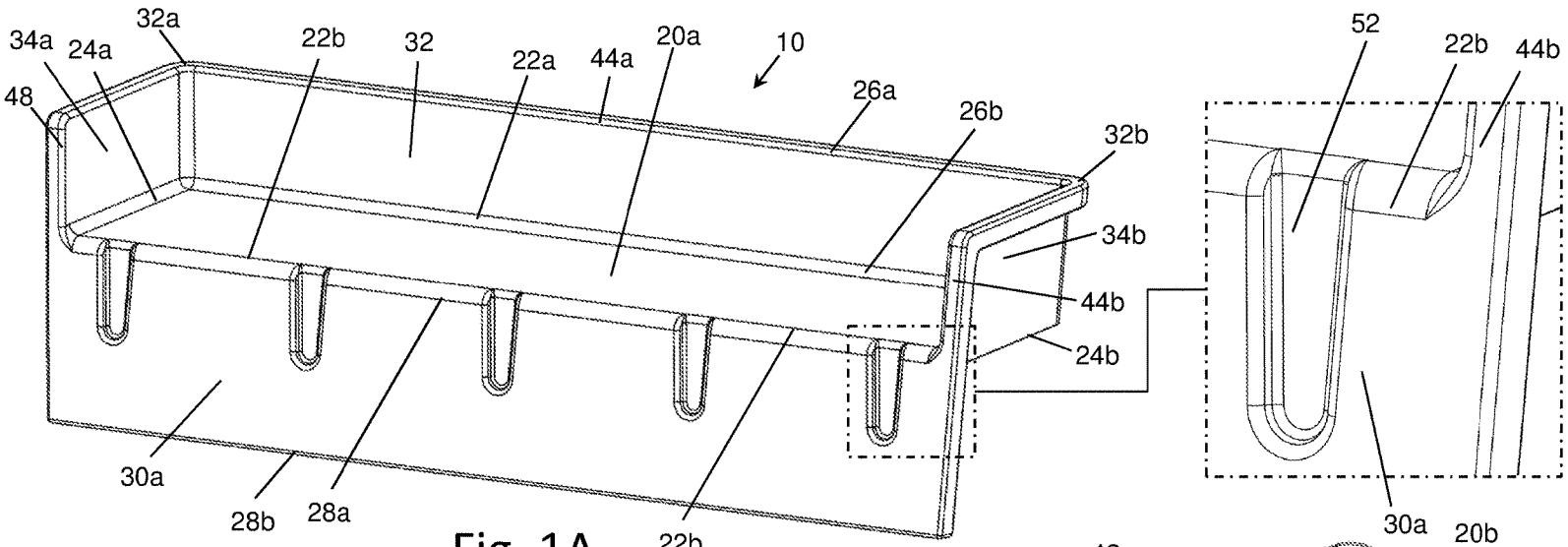
FIG. 1A shows a front, upper perspective view of a splashguard according to the invention described herein.
Figure 1B:
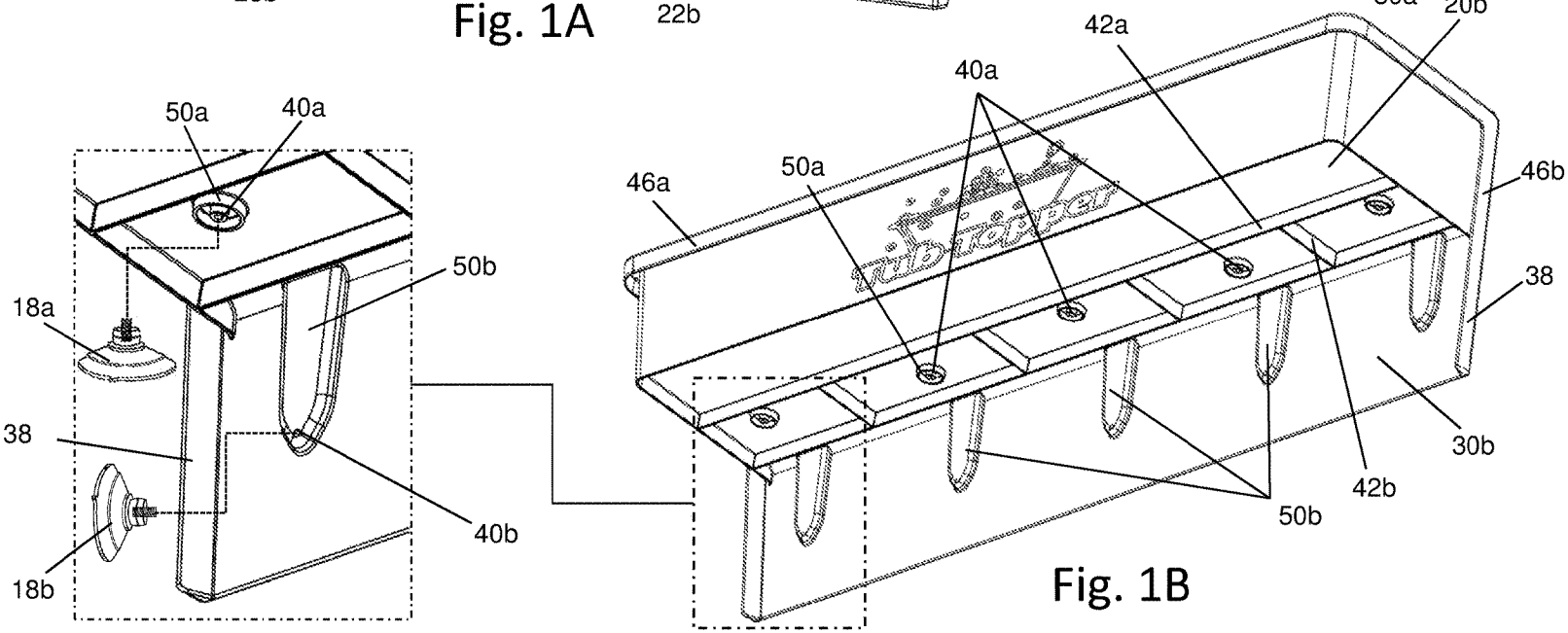
FIG. 1B shows a rear, lower perspective view of the splashguard from FIG. 1A with a detail exploded view of the splashguard with suction cup fasteners.
Figure 2A:
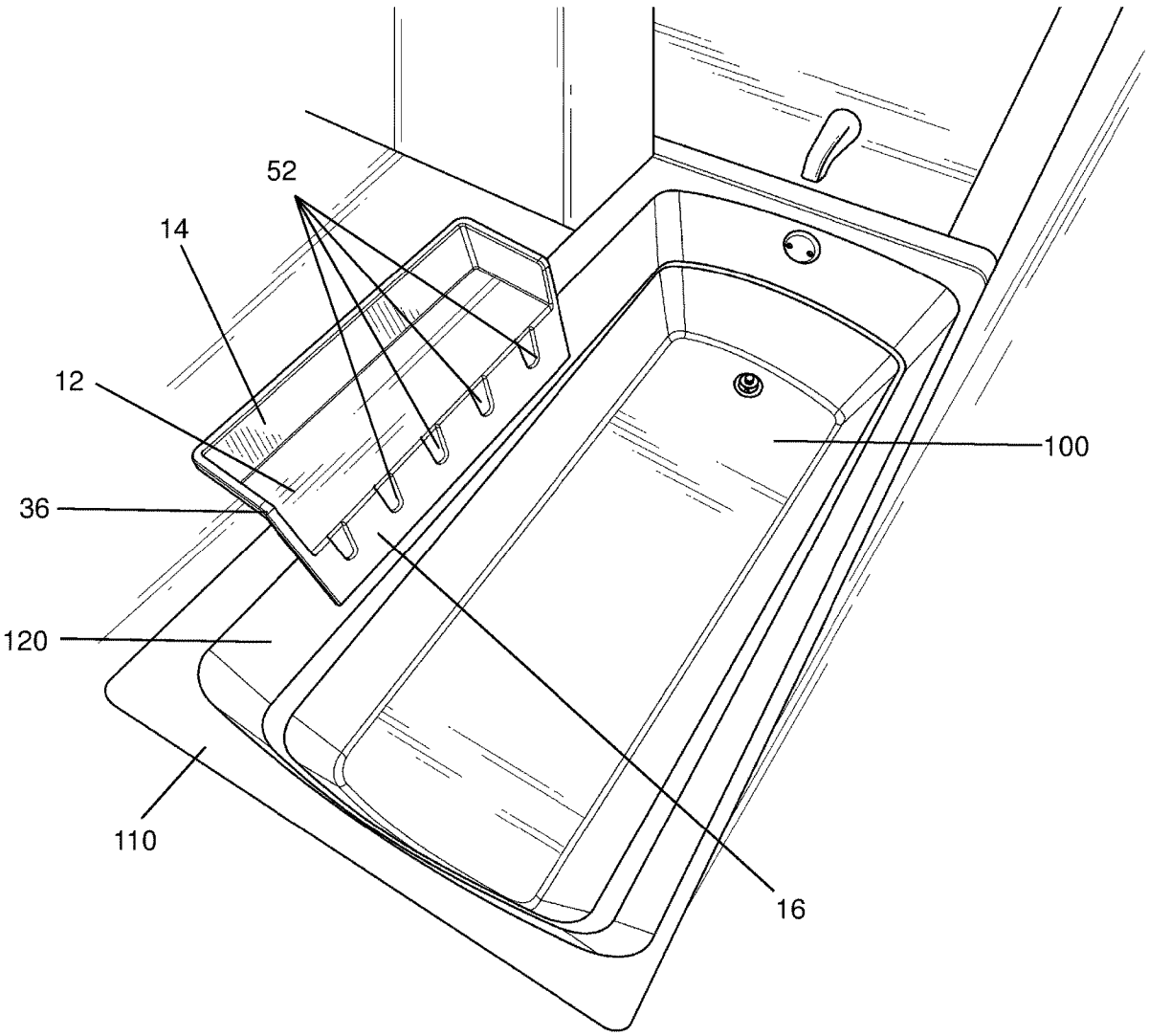
FIG. 2A shows a topside perspective view of the splashguard from FIG. 1A as it is attached to a bathtub.
Figure 2B:
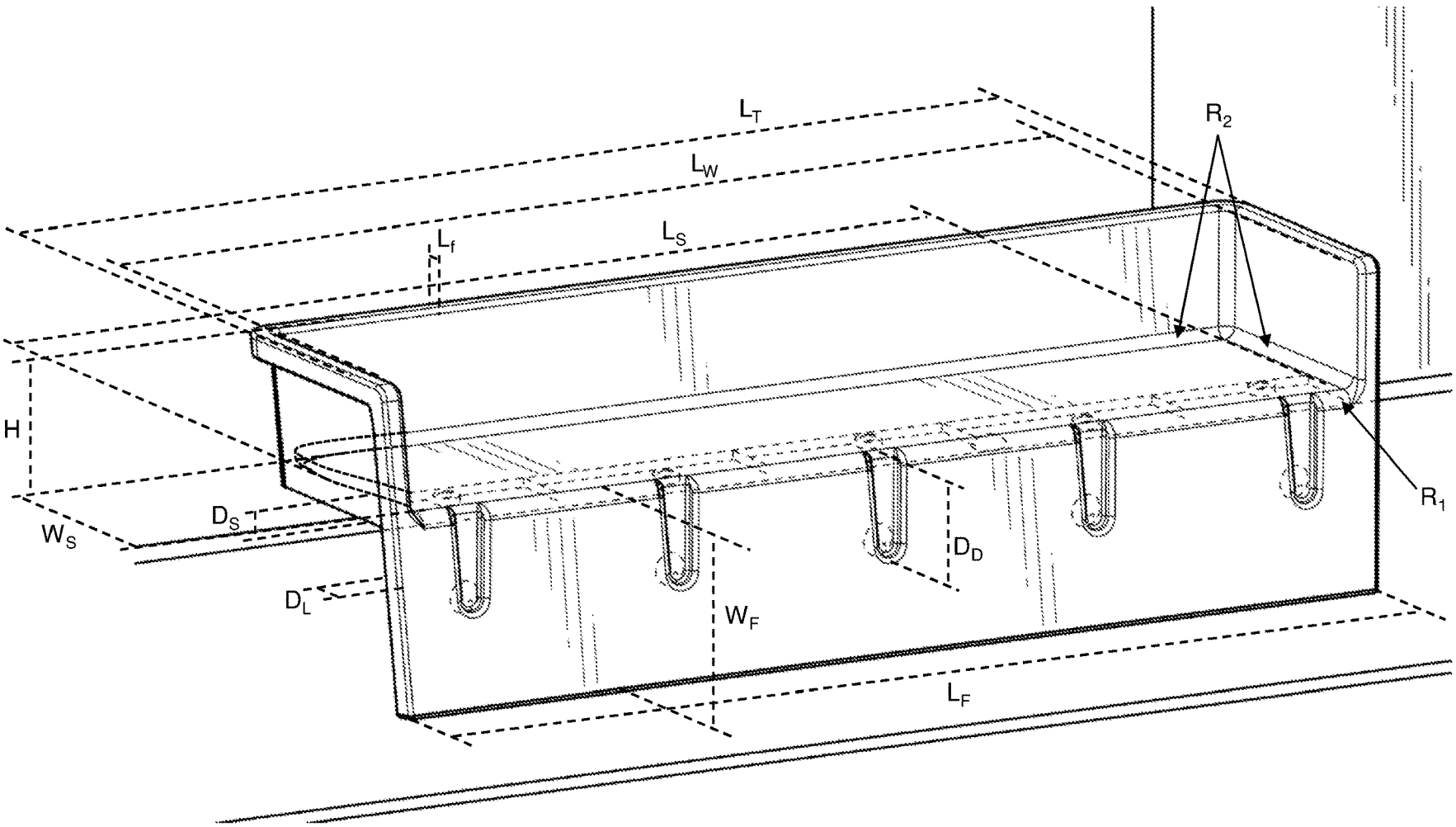
FIG. 2B shows a front perspective view of the splashguard from FIG. 1A as it is attached to a bathtub.

The splashguard 10 described herein provides a place for the children to play while helping to prevent water from being splashed onto the floor adjacent to the bathtub 100 and can also be a convenient place for holding items while bathing. Generally, as shown in FIGS. 1A and 2A, the splashguard has a shelf, a wall, and a flap. As shown in FIGS. 1B and 2B, the shelf is secured to the rim 110 of the bathtub with one set of fasteners while the flap is secured to the inner sidewall 120 of the bathtub by another set of fasteners. Suction cups are preferably used as the fasteners, but as explained below, other releasable and reusable fasteners could be used in place of the suction cups. It will also be appreciated that since the present invention allows for unobstructed accessibility to the bathtub between the splashguard and the end walls at either end of the tub, more permanent fasteners may be used for some installations, such as glue or some other adhesive epoxy that is preferably water-resistant or water-repellant.

The shelf 12 has a planar surface 20 with a topside 20*a*, an underside 20*b*, a forward edge 22*a*, a rearmost edge 22*b*, and a pair of side edges 24*a* and 24*b* extending between the forward edge and the rearmost edge. The shelf width ($W_S$) extends between the forward edge and the rearmost edge, and the shelf length ($L_S$) extends between the pair of side edges. The topside of the shelf's planar surface functions as a play area or storage surface, and the underside of the shelf's planar surface faces the bathtub's rim and has a set of integral mounts 40*a* which hold the fasteners 18*a* that are used to releasably connect the shelf to the rim. The underside of the shelf is spaced by a distance ($D_S$) from the rim of the bathtub by the fasteners but is preferably supported by a frame 42 around the fasteners and the mounts which provides support to the shelf so that it has rigidity and does not bend or bow when in use. The shelf's underside also preferably includes a set of integrally formed standoffs 50*a* that protrude downward from the underside of the shelf, and the shelf's integral mounts are formed as a part of the standoffs.

The forward edge of the shelf is aligned with the bathtub's rim, and as described in detail be below, the flap extends downward from the forward edge. The rearmost edge and the pair of side edges are closed off by the wall as explained in more detail below. In comparison, there is no wall section above the flap so the front of the splashguard is open towards the interior of the bathtub. When the splashguard is attached to the bathtub, a portion of the shelf's forward section along the forward edge is positioned over and is attached to the bathtub's rim while the shelf's rearward section 36 extends past the bathtub's outer sidewall and is cantilevered over the rim as particularly shown in FIGS. 2A and 2B. The front portion of the shelf's forward section preferably extends slightly past the inner sidewall into the bathtub. As explained below, the attachment of the flap to the bathtub's inner sidewall allows for the cantilevering the shelf's rearward section over the rim and past the outer sidewall, and it prevents the splashguard from rocking on the rim.

Figure 3:
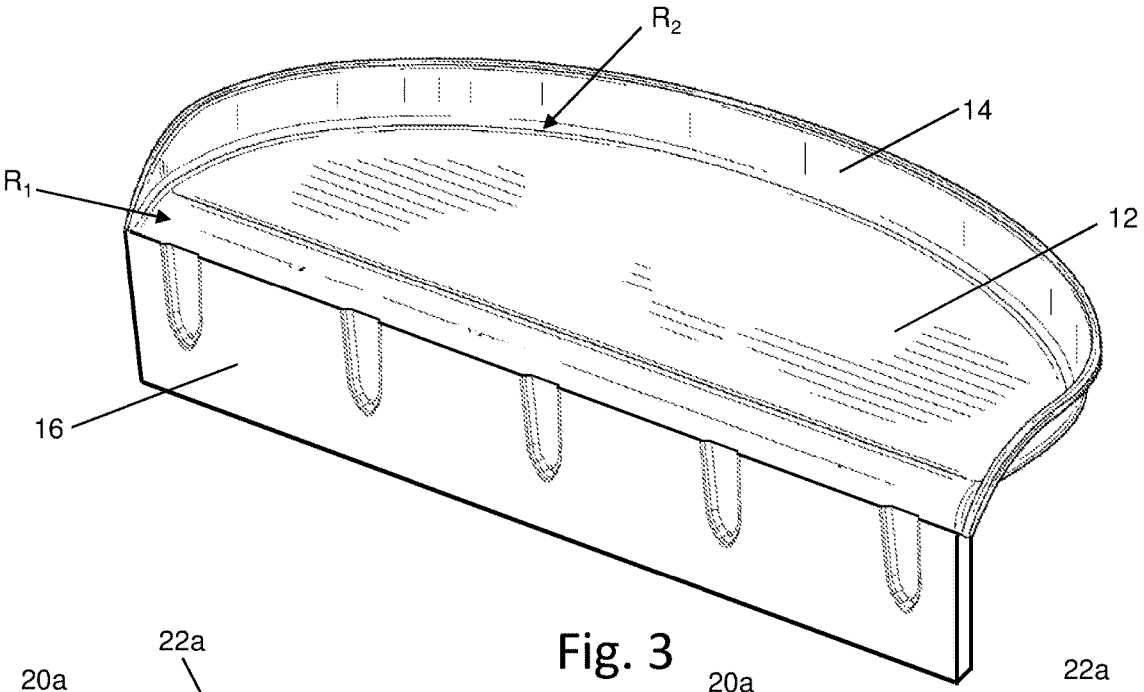
FIG. 3 shows a front, upper perspective view of an alternative splashguard according to the invention described herein.

Although the preferred embodiment shown in FIGS. 1 and 2 have a substantially rectangular shelf, it will be appreciated that the shelf can be formed in different shapes, such as shown in FIGS. 3 and 4 and described in more detail below. Generally, the forward edge of the shelf substantially matches the shape of bathtub rim and the flap preferably matches the shape of the inner sidewall to provide a good connection between the splashguard and the bathtub and optimize the space within the bathtub while reducing splashes from reaching the floor around the bathtub and allowing water to drain properly from the shelf surface back into the bathtub. The forward edge has a convex radius of curvature ($R_1$) on the topside of the shelf, and the rearmost edge and the side edges each have a concave radius of curvature ($R_2$) on the topside of the shelf. Apart from the curvature proximate to the edges, the planar surface of the shelf's topside is preferably flat and horizontal for holding items, and it may also be slightly angled downward from the rearmost edge to the forward edge to help direct water to the forward edge which it then pours over the flap and drains back into the bathtub. Additionally, some playtime friendly splashguards could have a shelf with a portion of the shelf having integrally molded design features, such as a simulated landscape or structures or a ramp for sliding toys into the bathtub similar to molded features in plastic play pools, such as disclosed in US. Design Pat. No. D222590 which is hereby incorporated by reference.

As indicated above, the wall 14 partially encloses the shelf. In particular, the shelf is partially surrounded along its rearmost edge and around its side edges by a back wall 32 and a pair of side end walls 34*a* and 34*b*, respectively. The back wall and side end walls extend upward from the concave radii of curvature at the rearmost edge and at the side edges, respectively, preventing water from spilling over the rearmost edge and the side edges of the shelf and directing water that is contained by the splashguard back into the bathtub. The wall attaches to the pair of side edges and the rearmost edge at its lower end 26*b*, and the wall extends upward to its top end 26*a*. The height (H) of the wall's top end as measured from the topside of the shelf is preferably less than the shelf width ($H<W_S$) and is greater than one-half the shelf width ($H>\frac{1}{2}*W_S$). The water that splashes onto the walls and the shelf during use drains back into the bathtub over the forward edge which is situated over the rim of the bathtub. To help direct the water from the shelf back into the bathtub, the flap is connected to the shelf along the forward edge and extends downward into the bathtub along the inner bathtub's sidewall.

For the rectangular shelf of the embodiment shown in FIGS. 1 and 2, the back wall extends between a pair of ends 32*a* and 32*b* that connect to corresponding back portions of the pair of side end walls. As evident from the embodiment shown in FIG. 3, the back wall can be curved so that it transitions into the side end wall sections. Generally, in each one of the embodiments, the wall has an interior-side wall length ($L_W$) between the pair of side edges which is substantially equal to the shelf length. Additionally, the top end of the wall, including the back wall and the side walls, preferably has a top flange 44*a* that extends peripherally outward from the wall by a flange length ($L_f$), and a top lip 46*a* protrudes downward from the top flange. The top flange and top lip can serve as a grip for users to grasp as they attach and remove the splashguard from the bathtub. Similarly, the pair of side end walls each preferably has a front flange 44*b* that extends peripherally outward from the side end walls' front portion 48 by the flange length, and a side lip 46*b* protrudes backward from the front flange. The flanges and lips are attached to each other and extend continuously around the entire periphery of the wall, from the front of the side walls up to the top end of the side walls and around the top end of the back wall, which helps provide additional strength and rigidity to the backsplash structure. Accordingly, the interior-side wall length plus the flange length for each front flange is equal to the total wall length for the top end of the wall ($L_W+2*L_f=L_T$). The back wall and at least a portion of the side end walls extend past the bathtub's rim and are cantilevered over the rim to the exterior space adjacent to the bathtub.

The flap 16 is attached to the forward edge of the shelf at its upper end 28*a* and extends downward from the convex radius of curvature along the bathtub's inner sidewall to its bottom end 28*b* within the bathtub, below its rim. The flap has a front face 30*a* over which the water flows when it drains back into the bathtub, a back face 30*b* which faces the inner sidewall, and a lip 38 that protrudes backward at each side of the flap. The flap's back face has another set of integral mounts 40*b* which hold the fasteners 18*b* that are used to releasably connect the flap to the sidewall. To help with draining water from the shelf, the flap's front face preferably includes drainage channels 52 extending downward from the upper end at the forward edge by a distance ($D_D$) that is partway toward the bottom end. The flap's back face is spaced by a distance ($D_L$) from the bathtub's inner sidewall by the fasteners so that the flap is cantilevered over the rim into the interior space of the bathtub. Additionally, the back face preferably includes another set of standoffs 50*b* that protrude backward from the back face toward the inner sidewall, and the flap's integral mounts are formed as a part of the standoffs. The flap width ($W_F$) between its upper end and its lower end is preferably greater than the height of the wall plus the distance that the shelf is spaced from the rim ($W_F > H + D_S$). The flap length ($L_F$) is at least as long as the shelf length ($L_F \geq L_S$) and is preferably equal to total wall length for the top end of the wall ($L_F = L_T$).

The standoffs can be molded with or permanently attached to the shelf's underside and the flap's back face as particularly shown in FIG. 1B and thereby house the integral mount. As shown in the drawings, the standoffs protrude a distance from the underside and the back face toward the bathtub's rim and the bathtub's inner sidewall, respectively. The standoffs have sidewalls extending to a protruding face. The frame around the standoffs on the shelf's underside can be molded or otherwise attached to the underside. The frame around the mounts may extend a distance from the underside that is equivalent to the distance of the fastener within the mount so that the frame can also provide support to the splashguard when it is attached to the bathtub. The frame around the mounts preferably has a pair of longitudinal walls 42*a* on opposite sides of the mounts and a series of lateral walls 42*b* between the mounts. The longitudinal walls extend the entire length of the shelf and connect to the bottom flange around the sides and back of the shelf's underside and the lateral walls connect between the longitudinal walls. The bottom flange is formed by the bottom end of the back wall and side end walls that extend past the topside of the shelf by a distance below the underside to engage so that the bottom end of the side end walls touch the bathtub's rim. The frame's longitudinal walls and lateral walls similarly extend this distance so that they also touch the bathtub's rim and provide support along the entire length of the shelf.

Given the space created by the fasteners and standoffs between the flap and the inner sidewall of the bathtub, it will be understood that the forward edge of the shelf and flap extended therefrom is along a different longitudinal plane than the inner sidewall of the bathtub and the inner bathtub rim. Accordingly, a gap exists between the side edges of the flap and the bathtub sidewall wherein water could splash there thru and over the rim of the bathtub, beneath the splashguard. The lip extends most or all of the distance ($D_L$) between the flap and the inner sidewall which blocks block water from splashing into the space at the sides of the flap. The lip extending back from the flap connects with the side lip extending back from the side flanges of the side walls so that there is a continuous lip from the side ends of the flap up extending to and continuing around the entire wall.

As generally described above, the flap may include drainage channels along the front face to further facilitate drainage from the planar surface into the bathtub basin. As shown in FIG. 1A, the drainage channels extend the channel length from the upper end towards their distal ends and include a recessed face between opposing channel walls spaced apart by a channel width with the recessed face being spaced from the front face of the flap by the recessed depth. Furthermore, the drainage channel on the front face of the flap may align with the standoff protruding on the back face of the flap. In such an embodiment, the drainage channel forms the negative on the front face of the flap to the standoff protruding on the back face of the flap with outer sides of the pair of sidewalls and protruding face being on the back face of the flap and inner sides of the pair of sidewalls and the recessed face being on the front face of the flap. However, it will also be appreciated that the drainage channel and standoff discussed herein do not necessarily align and could be positioned on the flap in alternating or non-alternating positions.

The splashguard described herein is sized to fit most bathtubs and to provide easy entry and exit from the bathtub while the splashguard is connected thereto. In particular, the splashguard is designed to have a length that is less than the length of the bathtub and cover a portion of the bathtub's rim so that it will fit on most bathtubs and provide an uninterrupted accessibility space on at least one end.

The splashguard is sized to only cover a portion of the bathtub's length and does not extend the entire length of the bathtub. As shown in FIGS. 2A and 2B, the ends of the splashguard is spaced a distance from the end of the bathtub to allow a person to enter and exit the bathtub without necessarily stepping over or entirely removing the splashguard. In addition, the splashguard can be used with various bathtubs and sized where it does not require the end of the splashguard to flushly contact both sidewalls of the stall in which the bathtub is situated to prevent spilling, as seen in the prior art. Similarly, the splashguard can be used in free standing bathtubs that are not situated within a stall between two opposing walls where the splashguard is sized to have a length between opposing ends that is less than the length of the bathtub. Further, the space between the end of the splashguard and the end of the bathtub can also be used by a parent who may want to sit on the rim of the bathtub while they help a child wash their hair without having to remove the splashguard.

Although the dimensions of the splashguard are not intended to be limiting, the preferred embodiment includes a wall length and a flap length that are approximately equal. Furthermore, the width of the splashguard between the forward edge and the rearmost edge is less than the length of the shelf. Further still, the splashguard can be manufactured to various lengths for particular uses. A larger splashguard may provide more space on one side of the bathtub for entry and exit on that side, whereas a smaller splashguard may provide sufficient space for entry and exit on both sides or for the parent to sit on either side of the bathtub's sidewall. A smaller splashguard that covers less than half the length of the tub may be used by adults who merely want a smaller surface to hold a book, candle or electronic device. Although the larger splashguard could also be used for holding these items, the larger splashguard with a length greater than half the length of the tub, such as shown in FIG. 2, is particularly beneficial for use with children wherein a larger playing surface will also result in a larger guard against splashes getting outside of the bathtub. In either case, it remains an aspect that the length of the splashguard is less than the length of the tub wherein the ends of the splashguard do not necessarily abut the sidewalls of the shower stall as described herein.

The splashguard according the preferred embodiment is rectangular in shape as described above but it will be appreciated that the shape of the splashguard is not intended to be limiting. For example, the shape of the shelf portion may be curved and match the shape of a curved bathtub wherein the inventive aspect of the splashguard is the planar shelf, walls, and flap. In particular, the shelf may have a have an oval shape with the rearmost edge being cantilevered over the bathtub's rim and the straight edge extending along the rim as shown in FIG. 3. In such an embodiment, the curved rearmost edge includes a single vertical sidewall that prevents spilling onto the floor and the straight edge will include a flap that protrudes into the bathtub. Thus, the number of edges on the shelf and corresponding sidewalls is not intended to be limiting.

Figure 4B:
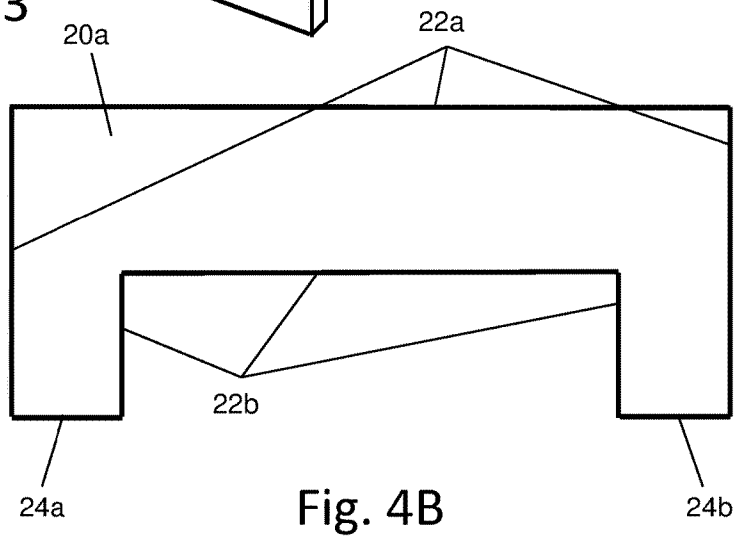
FIGS. 4A and 4B show top, plan views of alternative splashguards according to the invention described herein.
Figure 4A:
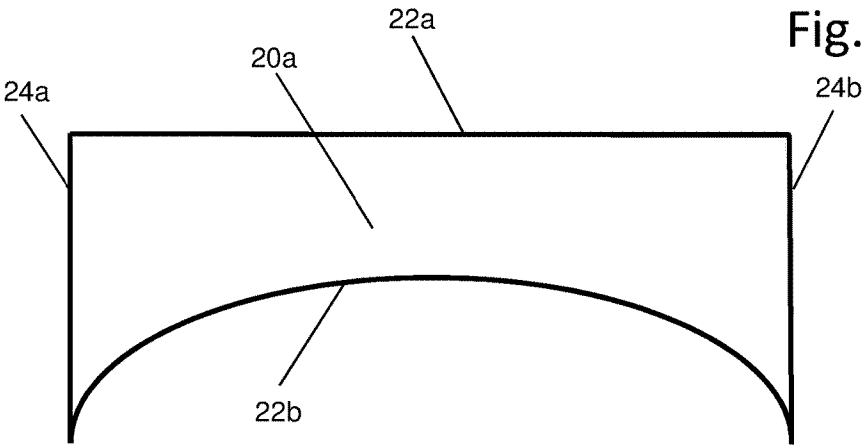

Further still, the shape of the shelf could be altered to fit around uniquely shaped bathtubs. For example, a splashguard may include a curved forward edge and corresponding flap that mirrors the end of a curved bathtub as shown in FIG. 4A. Similarly, the forward edge may be a "U" shape with a multi-segmented flap that can be used on the end of a rectangular bathtub with an open end, such as shown in FIG. 4B. In such an embodiment the splashguard would be attached to the end of the bathtub as opposed to the side of the bathtub and could include additional sets of suction cups on each of the flap segments.

Preferably, the splashguard is made out of silicone so it will not rot or collect bacteria but may also be made from other material types, such as plastic. In addition, the splashguard is made from a single molded piece product without any connecting fasteners that may tend to break or rust in wet environments. Accordingly, it is also preferred that the suctions cups that releasably connect the splashguard to the bathtub are molded within the single piece splashguard.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. For example, although suction cups are the preferred fasteners used for connecting the splashguard to the bathtub, it will be appreciated that there are numerous releasable and reusable fasteners that could be used in place of or in combination with the suction cups. For example, if it is desired to have a flap that is narrower than the diameter of the suction cups located at the underside of the shelf, it is possible that magnets could be used. The use of magnets to help secure splashguards to bathtubs is well-known and is described in U.S. Pat. No. 4,888,835 which is incorporated by reference herein. Similarly, one or both of the suction cup surfaces shown in FIG. 1B could use micro-suction gel tape segments which are sold under the brand names of Alien Tape and Monkey Tape, and/or branched nano tube gel tape segments which are sold under the brand name of Gecko Grip. For a shelf that has a flat underside, without any standoffs or framework, a line of gel tape could be placed on the underside so that it holds the underside tightly to the rim of the bathtub, and this gel tape could be beneficial for rims that are relatively narrow. Thus, the breadth and scope of the present invention should not be limited by any of the above-described exemplary embodiments, but should be defined only in accordance with the following claims appended hereto and their equivalents.

What is claimed is:

1. A splashguard for placement on and over a rim and an inner sidewall of a bathtub, respectively, comprising:

a shelf comprising a substantially planar surface with a topside, an underside, a forward edge, a rearmost edge, and a pair of side edges extending between the forward edge and the rearmost edge, wherein the shelf has a shelf width between the forward edge and the rearmost edge, wherein the underside of the shelf is comprised of a first set of mounts and a frame extending downward from the underside of the planar surface, wherein the frame comprises at least one lateral wall and at least one longitudinal wall and wherein the shelf has a shelf length between the pair of side edges;

a wall attached to the pair of side edges and the rearmost edge at a lower end of the wall, and wherein the wall extends upward from the lower end to a top end of the wall at a height above the topside of the shelf, and wherein the wall has an interior-side wall length between the pair of side edges at least as great as the shelf length;

a flap attached to the forward edge of the shelf at an upper end of the flap, wherein the flap comprises a front face and a back face, wherein the back face of the flap is comprised of a second set of mounts, and wherein the flap extends downward by a flap width from the upper end to a bottom end of the flap;

a first set of fasteners connected to the first set of mounts, wherein the first set of fasteners releasably connect the underside of the shelf to the rim of the bathtub, and wherein the frame is positioned between adjacent fasteners in the set of fasteners; and a second set of fasteners connected to the second set of mounts, wherein the second set of fasteners releasably connect the flap to the sidewall of the bathtub.

2. The splashguard of claim 1, wherein the height of the wall is greater than one-half the shelf width, wherein a portion of the planar surface of the shelf extends past the rim of the bathtub, and wherein at least a portion of the wall is cantilevered over the rim of the bathtub.

3. The splashguard of claim 2, wherein the height of the wall is less than the shelf width, wherein the wall is further comprised of a back wall and a pair of side end walls, wherein the back wall extends from a first end to a second end, wherein the first end and the second end connect to back portions of the pair of side end walls, wherein the forward edge is further comprised of a convex radius of curvature on the topside of the shelf, and wherein the rearmost edge and the side edges are each comprised of a concave radius of curvature on the topside of the shelf, wherein the flap extends downward from the convex radius of curvature, wherein the back wall extends upward from the concave radius of curvature at the rearmost edge, and wherein the side end walls extend upward from the concave radius of curvature at the side edges.

4. The splashguard of claim 1, wherein the comprised of a back wall and a pair of side end walls, and wherein the frame extends downward from at least one of the side end walls.

5. The splashguard of claim 1, wherein the underside of the shelf is spaced a first distance from the rim of the bathtub by the first set of fasteners, and wherein the frame extends downward to the rim of the bathtub at least as far as the first set of mounts.

6. The splashguard of claim 1, wherein the flap has a flap length at least as long as the shelf length, and wherein the flap width is greater than the height of the wall plus the first distance.

7. The splashguard of claim 1, wherein the underside of the shelf is further comprised of a first set of standoffs protruding downward from the underside of the shelf, wherein the first set of mounts are integrally formed as part of the first set of standoffs, and wherein the frame is further comprised of a set of lateral walls and a set of longitudinal walls around at least some of the mounts in the first set of mounts.

8. The splashguard of claim 7, wherein the back face of the flap is spaced a second distance from the inner sidewall of the bathtub by the second set of fasteners, wherein the back face of the flap further comprises a second set of standoffs protruding backward from the back face of the flap toward the inner sidewall of the bathtub, and wherein the second set of mounts are integrally formed as part the second set of standoffs.

9. The splashguard of claim 8, wherein the front face of the flap is further comprised of a plurality of drainage channels extending downward by a third distance from the upper end at the forward edge toward the bottom end, wherein a portion of the planar surface of the shelf extends past the inner sidewall into the bathtub, and wherein the flap is cantilevered over the rim into the bathtub.

10. The splashguard of claim 1, wherein the first set of fasteners and the second set of fasteners are selected from the group of releasable and reusable fasteners consisting of suction cups, magnets, micro-suction gel tape segments, branched nano tube gel tape segments, and any combination thereof.

11. A splashguard for placement on and over a rim and an inner sidewall of a bathtub between opposite bathtub ends, comprising:

a shelf comprising a substantially planar surface with a topside, an underside, a forward edge, a rearmost edge, and a pair of side edges extending between the forward edge and the rearmost edge, wherein the shelf has a shelf width between the forward edge and the rearmost edge, and wherein the shelf has a shelf length between the pair of side edges;

a wall attached to the pair of side edges and the rearmost edge at a lower end of the wall, wherein the wall extends upward from the lower end to a top end at a height above the topside of the shelf, wherein the height of the wall is less than the shelf width and is greater than one-half the shelf width, and wherein the wall has an interior-side wall length between the pair of side edges substantially equal to the shelf length;

a flap attached to the forward edge of the shelf at an upper end of the flap, wherein the flap extends downward by a flap width from the upper end to a bottom end of the flap, wherein the flap has a flap length at least as long as the shelf length, and wherein the flap width is greater than the height of the wall; and a first set of fasteners, wherein the first set of fasteners releasably connect at least one of the underside of the shelf to the rim of the bathtub and the flap to the sidewall of the bathtub.

12. The splashguard of claim 11, further comprising a first set of mounts permanently attached to at least one of the underside of the shelf and the back face of the flap, wherein the first set of fasteners are connected to at least one of the underside of the shelf and the back face of the flap through the first set of mounts.

13. The splashguard of claim 12, further comprising a second set of fasteners and a second set of mounts, wherein the first set of fasteners are connected to the underside of the shelf through the first set of mounts and releasably connect the shelf to the rim of the bathtub, and wherein the second set of fasteners are connected to the flap through the second set of mounts and releasably connect the flap to the sidewall of the bathtub.

14. The splashguard of claim 13, wherein the underside of the shelf is further comprised of a frame extending downward from the underside of the planar surface, wherein the topside of the shelf is spaced a first distance from the rim of the bathtub by the first set of fasteners, and wherein the frame is further comprised of a set of lateral walls and a set of longitudinal walls around at least some of the mounts in the first set of mounts.

15. The splashguard of claim 11, wherein the top end of the wall has a wall length greater than the interior-side wall length, wherein the flap length is substantially equal to the wall length at the top end of the wall, and wherein the flap is further comprised of a lip protruding backward at each side of the flap.

16. A splashguard for placement on and over a rim and an inner sidewall of a bathtub between opposite bathtub ends, comprising:

a shelf comprising a substantially planar surface with a topside, an underside, a forward edge, a rearmost edge, and a pair of side edges extending between the forward edge and the rearmost edge, wherein the shelf has a shelf width between the forward edge and the rearmost edge, wherein the shelf has a shelf length between the pair of side edges, and wherein the shelf is further comprised of a frame with a set of lateral walls and a set of longitudinal walls extending downward from the underside of the planar surface;

a wall attached to the pair of side edges and the rearmost edge at a lower end of the wall, wherein the wall extends upward from the lower end to a top end at a height above the topside of the shelf, and wherein the wall has an interior-side wall length between the pair of side edges at least as great as the shelf length;

a flap attached to the forward edge of the shelf at an upper end of the flap, wherein the flap extends downward by a flap width from the upper end to a bottom end of the flap;

a first set of mounts permanently attached to at least one of the underside of the shelf and the back face of the flap;

a first set of fasteners connected to the first set of mounts, wherein the first set of fasteners releasably connect at least one of the underside of the shelf to the rim of the bathtub and the flap to the sidewall of the bathtub.

17. The splashguard of claim 16, further comprising a second set of fasteners and a second set of mounts, wherein the first set of fasteners are connected to the underside of the shelf through the first set of mounts and releasably connect the shelf to the rim of the bathtub, and wherein the second set of fasteners are connected to the flap through the second set of mounts and releasably connect the flap to the sidewall of the bathtub.

18. The splashguard of claim 16, wherein the wall is further comprised of a back wall and a pair of side end walls, wherein the back wall extends from a first end to a second end, wherein the first end and the second end connect to back portions of the pair of side end walls, wherein the top end of the wall is further comprised of a top flange extending peripherally outward from the wall by a flange length and a top lip protruding downward from the top flange, wherein the pair of side end walls are each further comprised of a front flange extending peripherally outward from a front portion of the respective side end walls by the flange length and a side lip protruding backward from the front flange, wherein the wall length at the top of the wall is equal to the interior-side wall length plus the flange length for each front flange, and wherein the flap is further comprised of a lip protruding backward at each side of the flap.

19. The splashguard of claim 18, wherein the height of the wall is greater than one-half the shelf width, wherein the top end of the wall has a wall length greater than the interior-side wall length, wherein a portion of the planar surface of the shelf extends past the rim of the bathtub, wherein the back portions of the pair of side end walls and the back wall are cantilevered over the rim of the bathtub, wherein the flap width is greater than the one-half of the height of the wall, and wherein the flap has a flap length greater than the interior-side wall length and substantially equal to the wall length at the top end of the wall.

20. The splashguard of claim 16, wherein the first set of fasteners are connected to the underside of the shelf through the first set of mounts and releasably connect the shelf to the rim of the bathtub, and wherein the set of lateral walls and the set of longitudinal walls of the frame are positioned around at least some of the mounts in the first set of mounts.

* * * * *